US011520248B2

(12) United States Patent
Eyal et al.

(10) Patent No.: US 11,520,248 B2
(45) Date of Patent: Dec. 6, 2022

(54) TRANSFERRING PRINTING FLUID TO A SUBSTRATE

(71) Applicant: Hewlett-Packard Development Company, L.P., Spring, TX (US)

(72) Inventors: Ehud Eyal, Ness Ziona (IL); Eric Nelson, Boise, ID (US); Nadav Shalem, Ness Ziona (IL)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/289,914

(22) PCT Filed: Dec. 12, 2018

(86) PCT No.: PCT/US2018/065280

§ 371 (c)(1),
(2) Date: Apr. 29, 2021

(87) PCT Pub. No.: WO2020/122905

PCT Pub. Date: Jun. 18, 2020

(65) Prior Publication Data

US 2022/0004115 A1 Jan. 6, 2022

(51) Int. Cl.
*G03G 15/06* (2006.01)
*G03G 15/10* (2006.01)

(52) U.S. Cl.
CPC ..... *G03G 15/065* (2013.01); *G03G 15/10* (2013.01)

(58) Field of Classification Search
CPC ..... G03G 15/065; G03G 15/10
USPC ..... 399/38, 53, 55
See application file for complete search history.

(56) References Cited

U.S. PATENT DOCUMENTS

| | | | | |
|---|---|---|---|---|
| 4,027,964 | A * | 6/1977 | Fantuzzo | G03G 15/102 399/147 |
| 5,048,983 | A | 9/1991 | Fukae | |
| 5,099,281 | A | 3/1992 | Bhagat | |
| 5,115,277 | A | 5/1992 | Camis | |
| 5,987,283 | A | 11/1999 | Zhao et al. | |
| 6,311,035 | B1 | 10/2001 | Liu et al. | |
| 7,071,958 | B2 | 7/2006 | Liaw et al. | |
| 7,209,154 | B2 | 4/2007 | Matsuzoe | |
| 7,388,594 | B2 | 6/2008 | Kim et al. | |
| 7,481,884 | B2 | 1/2009 | Stelter et al. | |
| 2002/0047887 | A1 | 4/2002 | Koga et al. | |
| 2002/0146558 | A1 | 10/2002 | Kamoshida et al. | |
| 2003/0071885 | A1 | 4/2003 | Kamoshida et al. | |
| 2004/0021759 | A1 | 2/2004 | Kamoshida et al. | |
| 2004/0227802 | A1 | 11/2004 | Liaw et al. | |

(Continued)

FOREIGN PATENT DOCUMENTS

| | | |
|---|---|---|
| CN | 1213438 A | 4/1999 |
| EP | 1019787 | 10/2002 |

(Continued)

*Primary Examiner* — Hoan H Tran

(57) ABSTRACT

Some examples relate to printing apparatuses and methods. In an example, a roller transfers printing fluid to a substrate. In some examples an electrically grounded roller is positioned proximate the electrically charged roller and guides the substrate. In some examples, the roller is an electrically charged roller. In some examples an electric field is applied and its strength is varied based on a dielectric coefficient of the substrate and/or a thickness of the substrate.

15 Claims, 3 Drawing Sheets

(56) References Cited

U.S. PATENT DOCUMENTS

| | | | |
|---|---|---|---|
| 2005/0202164 | A1 | 9/2005 | Stelter et al. |
| 2005/0259140 | A1 | 11/2005 | Kim et al. |
| 2006/0109332 | A1 | 5/2006 | Matsuzoe |
| 2006/0288896 | A1 | 12/2006 | Fukui et al. |
| 2010/0033546 | A1 | 2/2010 | Kweon et al. |
| 2013/0094870 | A1 | 4/2013 | Shimizu et al. |
| 2014/0060357 | A1 | 3/2014 | Hsieh |
| 2016/0243764 | A1 | 8/2016 | Hays et al. |
| 2016/0279667 | A1 | 9/2016 | Noda et al. |

FOREIGN PATENT DOCUMENTS

| | | | |
|---|---|---|---|
| GB | 2233605 | | 1/1991 |
| JP | 5681857 | | 7/1981 |
| JP | 58-162353 | A | 9/1983 |
| JP | 61-034559 | A | 2/1986 |
| JP | 0383080 | | 4/1991 |
| JP | 05142967 | | 6/1993 |
| JP | 06266184 | | 9/1994 |
| TW | 200707140 | A | 2/2007 |
| TW | 200944609 | A | 11/2009 |
| WO | 2018/169511 | A1 | 9/2018 |

* cited by examiner

TRANSFERRING PRINTING FLUID TO A SUBSTRATE

BACKGROUND

In some printing systems, printing fluid such as an ink is transferred from an inking roller to an advancing substrate.

BRIEF DESCRIPTION OF DRAWINGS

Examples will now be described, by way of non-limiting example, with reference to the accompanying drawings, in which.

DETAILED DESCRIPTION

Some printing systems that transfer a printing fluid, such as ink (e.g. conductive ink), to a substrate comprise a number of rollers that, through their rotation transfer ink to a substrate advancing through the printing system. For example, a first roller may collect ink from a reservoir and, via rotational engagement with a second roller (such as a photoreceptor), transfer a portion of that ink to the second roller (and a latent image formed thereon). The second roller may then transfer the ink from the inked latent image to a substrate advancing between the second roller and a third roller. These example printing systems may function to print a specific image (e.g. the latent image) onto a particular substrate.

Some examples herein relate to printing systems and methods that are capable of transferring ink to a substrate without an intermediate member (e.g. a roller) in between two rollers (such as a guide roller and a roller to transfer ink to the substrate).

Figure 1:
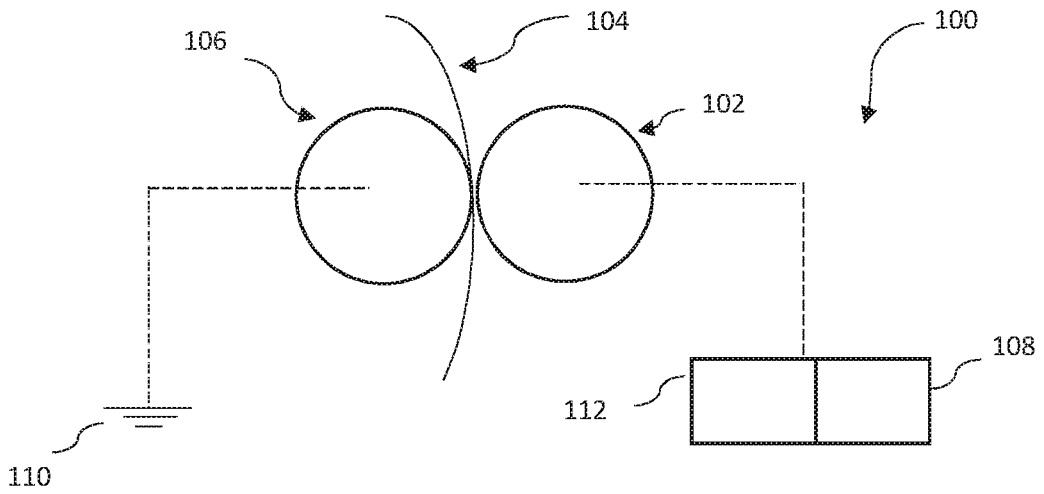
FIG. 1 is a simplified schematic of an example of apparatus.

FIG. 1 shows an example apparatus 100. The apparatus 100 may be an apparatus to deposit or transfer ink to a substrate. In one example the apparatus 100 may be a printing apparatus.

The apparatus 100 comprises a first roller 102. The first roller 102 is to transfer printing fluid (not shown in FIG. 1), such as ink, to a substrate 104 and is connected to a source 112 of electrical potential. For example, an printing fluid supply apparatus, or applicator, may engage the first roller 102 so as to deposit printing fluid thereon. In one example, an printing fluid applicator is to transport a supply of printing fluid to the surface of the first roller 102, for example the printing fluid applicator may be a roller in contact with a printing fluid reservoir, wherein revolutions of the printing fluid applicator roller may cause printing fluid from the reservoir to be deposited onto its surface, and the printing fluid applicator roller may, via contact between the ink applicator roller and the first roller 102, transfer its ink to the first roller 102. In some examples the first roller 102 may be a binary ink developer.

The apparatus 100 comprises an electrically grounded roller 106. The electrically grounded roller 106 is positioned proximate to the electrically charged roller 102. During a print or inking operation, the apparatus 100 may be to advance the substrate 104 between the grounded roller 106 and the first roller 102. The first and grounded rollers 102, 106 may be rotatable. For example, the first and grounded rollers 102, 106 are rotatable so as to guide (or, in some examples, advance) a substrate 104 through the apparatus 100. In other examples, a separate (not shown) drive unit may be to advance the substrate 104 through the apparatus 100 and in between the two rollers 102, 106.

The electrically grounded roller 106 is connected to the ground 110. That is, the potential of the electrically grounded roller 106 is maintained at 0V. For example, the electrically grounded roller 106 may comprise an end surface which rotates, along with the rest of the grounded roller 106, about a central grounded roller axis. A rotatable coupling such as bearing, bushing or brush (e.g. a brush spring-biased into contact with the electrically grounded roller 106) may be connected to the ground 110 and, via its engagement with the electrically grounded roller 106, may maintain the grounded roller 106 at a potential of 0V.

In one example the grounded roller 106 may comprise a conductor. For example, an outer surface of the grounded roller 106 may comprise a conductor. The conductor may comprise a metal. In one example the grounded roller may comprise a metallic outer surface. In examples that utilise a rotatable coupling, a metallic outer surface, or metallic part of the grounded roller 106, may be in contact with the rotatable coupling so as to connect the grounded roller 106 to the ground 110.

In the example of FIG. 1 the first roller 102 is maintained at a negative potential. For example, the first roller 102 is connected to a source of direct current (DC) and a controller 108 is to control the current supplied to the electrically charged roller 102, e.g. to maintain a negative potential. In this way the first roller 102 may be referred to as an electrically charged roller 102 since, as explained in further detail below, charge accumulation as a result of the electrical connection to the source 112 may result in a potential difference between the two rollers 102, 106. The charged roller may comprise a semiconducting material.

For example, the charged roller 102 may be in contact with a rotatable coupling such as a bearing, bushing or brush, and the rotatable coupling may be in contact with a source of DC (e.g. a negative terminal thereof, such as a negative electrode). For example, the DC source may supply current to the charged roller 102 via a rotatable coupling comprising a conductor. The conductor may comprise a metal. For example, a bearing comprising a metallic bearing housing may be connected to a conductor (e.g. copper wire etc.) connected to a DC source. A rotatable bearing element within the bearing housing may then transfer the current from the conductor, through the bearing housing, to part of the charged roller 102 to supply the current to the charged roller 102, e.g. to maintain it at a negative potential. In one example, the charged roller 102 may be connected to a source of alternating current (AC), and the controller 108 may be to vary the strength and/or frequency of the AC. In this example, the apparatus 100 may comprise a rectifier to convert the AC to DC.

In one example, (e.g. in use) the charged roller 102 is connected to a source of DC, e.g. under the control of the controller 108, so as to supply current to the charged roller 102. In another example (as above), the charged roller 102 may be connected to source of AC. The current source and charged roller 102 therefore form an open circuit as charge from the current source accumulates on the charged roller 102. For example, current supplied to the charged roller 102 may cause a region of negative charge to accumulate on the surface of the charged roller 102 (positive charge may accumulate toward the centre of the charged roller 102). As a result, a potential difference, or voltage, is created across the gap between the charged roller 102 and the grounded roller 106. An electric field may therefore form between the charged roller 102 and the grounded roller 106. The air between the surfaces of the charged roller 102 and grounded roller 106 may develop an electrical conductivity. The apparatus 100 (e.g. under the control of a controller, e.g. controller 108) may advance the substrate 104 in between the charged and grounded rollers 102, 106, and printing fluid may be transferred to the charged roller 102, e.g. as described above. As printing fluid is transferred to the charged roller 102, and the charged roller 102 rotates, the printing fluid on the surface of the charged roller 102 will be rotated into proximity with the grounded roller 106, and rotated into proximity with the substrate 104 advancing in between the two rollers 102, 106. Due to the potential difference (electric field) in between the two rollers 102, 106, printing fluid on the surface of the charged roller 102 may be caused to migrate toward the grounded roller 102 whereupon it will be deposited onto the surface of the substrate 104 advancing in between. The apparatus 100 therefore forms an open circuit in which accumulated charge on the charged roller 102 is unable to migrate to the grounded roller to complete the circuit, thereby causing a potential difference therebetween, the potential difference and resulting electric field facilitating the transfer of ink toward the ground, and therefore toward the substrate. The substrate 104 thereby forms an effective resistor in this open circuit. Therefore, the apparatus 100 deposits ink onto the surface of the substrate 104.

The printing fluid may therefore comprise conductive ink and may, when placed in an electric field, flow towards a higher potential. For example the ink may comprise charged particles and an applied electric field may cause the charged particles to move towards a higher potential, for example the ink may comprise negatively charged particles). In the example of FIG. 1, the charged roller 102 is maintained at a negative potential (in one example a constant negative potential) and therefore the ink, due to the potential difference between the two rollers 102, 106 migrates toward the grounded roller 102, being the higher potential at 0V in this example.

In one example, the controller 108 is to vary the strength of the DC in proportion to the dielectric coefficient of the substrate. For example, substrates of different composition (e.g. comprising plastic or paper) or of different thickness may comprise different dielectric coefficients. Generally speaking, the higher the dielectric coefficient the higher the potential difference between the grounded 106 and charged 102 roller needs to be for ink to successfully migrate from the charged roller 102 to the grounded roller 106 and therefore to be deposited onto the substrate 104. In some examples the thicker the substrate 104 the higher the dielectric coefficient. Accordingly, in some examples the controller 108 may be to measure the thickness of the substrate 104 and adjust the current supplied to the charged roller 102 based on the measured thickness. In other examples, the controller 108 may comprise a memory, and the dielectric coefficient of a particular substrate 104 may be entered into the controller 108 which (e.g. via a look-up table) may associate a particular current value to supply to the charged roller 102 so as to ensure ink migration toward the grounded roller 102 for that substrate 104.

The potential of the charged roller 102 and grounded roller 106 may therefore be relative to the dielectric coefficient of the substrate. In one example the controller 108 may be to maintain the charged roller 102 at −400V, and, in response to a change in dielectric coefficient of the substrate (which may result from an increased thickness of the substrate), the controller 108 may be to maintain the charged roller at −1000V. In some examples, the first roller 102 may be connected to a source of electrical potential such that the potential is non-uniform along a dimension (e.g. a length) of the first roller.

The apparatus 100 may be to substantially cover the substrate 104 with printing fluid. For example, the apparatus 100 may be to print a background on a substrate 104. For example, if the electrically charged roller 102 is to receive red ink then, in use, the apparatus 100 may be to substantially cover the substrate 104 with red ink, thereby printing a red background onto the substrate. In this way the apparatus 100 may be to "flood" the substrate 104 with ink. For example, the substrate 104 may be a paper or plastic substrate intended for use with product packaging and the apparatus 100 may be to print a background colour onto the substrate.

Figure 2:
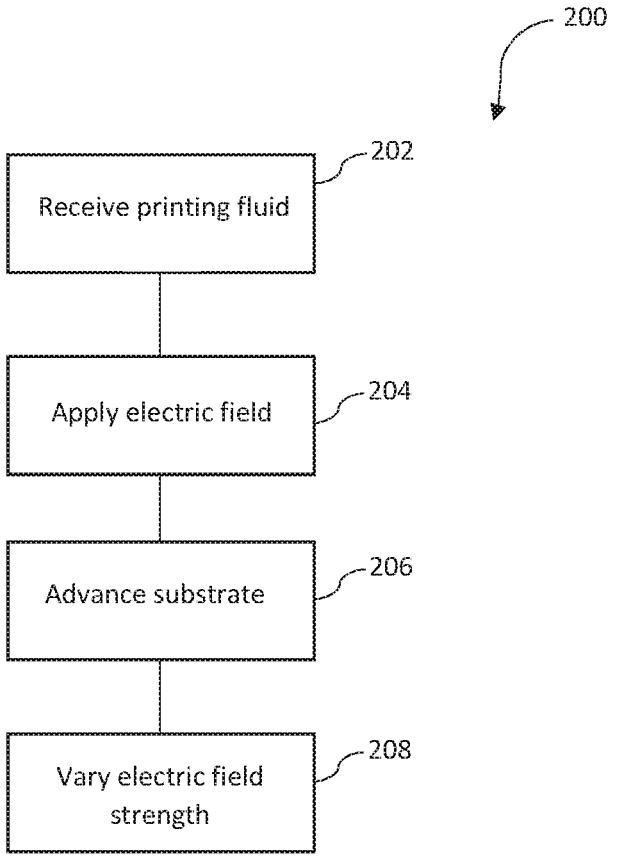
FIG. 2 is a flowchart of an example of a method.

FIG. 2 shows an example method 200. The method 200 may be a method of printing (or transferring or depositing) printing fluid to a substrate. The method 200 may be a method of printing a substrate. The method 200 may be a method of substantially flooding a substrate with printing fluid.

The method 200 comprises, at block 202, receiving printing fluid at a developer roller. The developer roller may be a binary ink developer. Block 202 may comprise engaging a developer roller with an ink applicator (e.g. a roller) which is in contact with an printing fluid reservoir so as to transfer printing fluid from the reservoir to the developer roller. In one example, the developer roller may be in contact with the printing fluid reservoir. In one example rotatable contact between the printing fluid applicator roller and the develop roller may facilitate the printing fluid transfer and therefore in one example block 202 of the method 200 may comprise engaging the printing fluid applicator roller to transfer printing fluid from a printing fluid reservoir to the developer roller.

The method 200 comprises, at block 204, applying an electric field in the region of the developer roller. The method 200 comprises, at block 206, advancing a substrate proximate the developer roller. For example, block 206 may comprise advancing a substrate proximate the developer roller and a second roller. Block 206 may comprise advancing a substrate in between the developer roller and a second roller. The second roller may be a grounded roller.

In one example applying the electric field, at block 204, comprises controlling two electrodes (one positive, one negative) in a region of the developer roller. In this example, the negative electrode may be proximate the developer roller and the positive electrode may be proximate the second roller. This creates an electric field and potential difference between the developer roller and a second roller (e.g. advancing the substrate) which causes the ink at the developer roller to migrate toward the second roller (at higher potential) whereupon it will be deposited on the advancing substrate. In another example, applying an electric field, at block 204, may comprise applying a current through the developer roller. For example, current may be supplied to the developer roller so that it is maintained at a negative potential. In another example, current may be supplied to the developer roller so that it is maintained at a negative potential and a second roller guiding the substrate may be maintained at a negative potential (but less negative, and therefore more positive, than the negative potential of the developer roller) or may be maintained at 0V (e.g. grounded). In another example, current may be supplied to the developer roller so that it is maintained at a positive potential and a second roller guiding the substrate may be maintained at a positive potential (but a higher positive potential than the developer roller), ink in this example therefore migrating toward the second roller (the more positive potential) to be deposited on the advancing substrate. The second roller may be a guide roller to guide the substrate or a drive roller to advance the substrate. Thus, in one example, block 206 comprises advancing the substrate between the developer roller and an electrically grounded roller.

The method 200 comprises, at block 208, varying the strength of the electric field based on a dielectric coefficient, and/or a thickness, of the substrate. As the dielectric coefficient (and its thickness) of the substrate may affect the printing fluid transfer to the substrate (e.g. the percentage of printing fluid that is transferred from the developer roller onto the substrate), in some examples block 208 may comprise measuring a thickness of the substrate 104 to infer the dielectric coefficient and varying the electric field based on the measurement. For example, block 208 may comprise consulting a look-up table, the look-up table being able to associate a current to a dielectric coefficient (or a thickness of the substrate), and the current may be adjusted to that value. In another example, the look-up table may associate a field strength to a dielectric coefficient.

In one example, block 204 comprises supplying a current to the developer roller so as to create a potential difference between the developer roller and the substrate or a region proximal thereto. As above, this will facilitate printing fluid migration towards and onto the substrate. In this example, block 208 comprises varying the current supplied to the develop roller based on the dielectric coefficient of the substrate.

In one example, block 206 comprises advancing the substrate in between the developer roller and a second, guide, roller, and block 204 comprises supplying a current to the developer roller and connecting the guide roller to the ground. In this example, block 206 comprises supplying current to the developer roller so that it is at a negative potential. In this example, a potential difference is created between the developer roller and the guide roller causing the printing fluid to migrate toward the higher potential (the ground in this case). In this example block 208 comprises varying the current level supplied to the developer roller in proportion to the dielectric coefficient of the substrate. In another example, block 204 comprises supplying a first current to the developer roller and a second current to the guide roller. The first current may be to maintain the developer roller at a lower potential than the guide roller so that the guide roller is at a higher potential, thereby ensuring that ink migration is from the developer roller toward to the guide roller (migrating in being deposited on the substrate advancing therebetween). In this example block 208 comprises varying the current supplied to one, or both, of the developer roller and the guide roller. For example, to increase the potential difference between the rollers, e.g. varying the electric field, block 208 may comprise increasing the current to the guide roller and/or decreasing the current to the developer roller.

In one example, block 204 may comprise supplying a current to maintain the developer roller at a potential of −400V and, block 208 may comprise supplying a current to maintain the developer roller at −1000V, e.g. in response to a changing dielectric coefficient of the substrate. In another example, block 204 may comprise supplying a current to maintain the developer roller at +40V and supplying a current to maintain the guide roller at +250V.

In one example, applying the electric field at block 204 comprises supplying two electrodes with a current or a source of electrical potential. For example, in one example block 204 comprises supplying a electrical potential to two conductive plates such that they are at a different electrical potential to thereby create a voltage therebetween.

Figure 3:
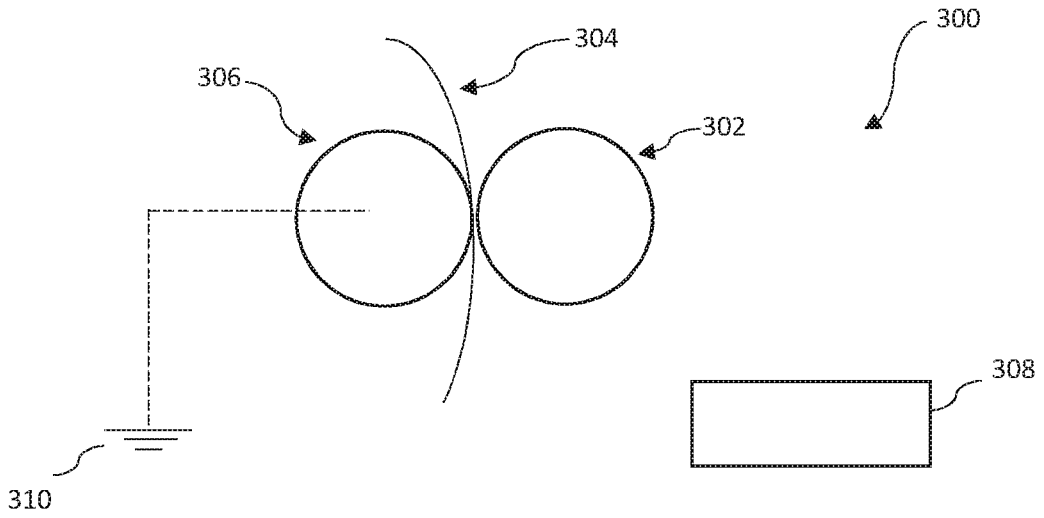
FIG. 3 is a simplified schematic of an example of apparatus.

FIG. 3 shows an example apparatus 300. The apparatus 300 may be an apparatus to deposit or transfer printing fluid to a substrate. In one example the apparatus 300 may be a printing apparatus.

The apparatus 300 comprises a developer roller 302. The developer roller 302 is to receive printing fluid (not shown in FIG. 3) and to transfer a portion of the printing fluid to a print target, such as a print media 304. For example, a printing fluid supply apparatus, or applicator, may engage the developer roller 302 so as to deposit printing fluid thereon. In one example, an ink applicator is to transport a supply of printing fluid to the surface of the developer roller 302, for example, the printing fluid applicator may be a roller in contact with a printing fluid reservoir, wherein revolutions of the printing fluid applicator roller may cause printing fluid from the reservoir to be deposited on to the surface thereon, and the printing fluid applicator roller may, via contact between the printing fluid applicator roller and the developer roller 302, transfer printing fluid to the developer roller 302. In some examples the developer roller 302 may be a binary ink developer.

The apparatus 300 comprises an electrically grounded roller 306. The electrically grounded roller 306 is to direct a print media 304 between the developer roller 302 and the grounded roller 306. During a print operation, the apparatus 300 is to advance the print media 304 between the grounded roller 306 and the developer roller 302. The developer and grounded rollers 302, 306 may be rotatable. For example, the developer and grounded rollers 302, 306 may be rotatable so as to guide or advance a print media 304 through the apparatus 300. In other examples, a (not shown) drive unit may be to advance the print media 304 through the apparatus 300 and in between the two rollers 302, 306.

The electrically grounded roller 306 is connected to the ground 310. That is, the potential of the electrically grounded roller 306 is maintained at 0V. For example, the electrically grounded roller 306 may comprise an end surface which rotates, along with the rest of the grounded roller 306, about a central grounded roller axis. A rotatable coupling such as bearing, bushing or brush (e.g. a brush spring-biased into contact with the electrically grounded roller 306) may be connected to the ground 310 and, via its engagement with the electrically grounded roller 306, may maintain the grounded roller 306 at a potential of 0V.

In one example the grounded roller 306 may comprise a conductor. For example, an outer surface of the grounded roller 306 may comprise a conductor. The conductor may comprise a metal. In one example the grounded roller may comprise a metallic outer surface. In examples that utilise a rotatable coupling, a metallic outer surface, or metallic part of the grounded roller 306, may be in contact with the rotatable coupling so as to connect the grounded roller 306 to the ground 310.

The apparatus 300 comprises a controller 308. The controller 308 is to apply an electric field between the developer roller 302 and the grounded roller 306. Therefore, in one example the controller 308 is to apply an electric field in the vicinity of the print media 304. In one example, the controller 308 is to apply an electric field in the gap between the developer roller 302 and the grounded roller 306.

In one example, the controller 308 is to apply an electric field such that there is a negative potential in a region remote from the substrate and/or the controller 308 is to apply an electric field such that there is a negative potential in a region proximate the developer roller. In this way, there will be a potential difference between the developer roller 302 and the grounded roller 306 which will cause ink from the developer roller to migrate toward the grounded roller 306 whereupon it will be deposited onto the print media 304 advancing between the rollers 302, 306. In one example the controller 308 is to control the current supplied to a negative electrode to create the electrical field and potential difference between the rollers 302, 306. In this example the negative electrode may be proximate the developer roller 302.

In one example, the controller 308 is to vary the strength of the DC in proportion to the dielectric coefficient of the print media, as print medias of different composition (e.g. comprising plastic or paper) or of different thickness may comprise different dielectric coefficients. In some examples the controller 308 may be to measure the thickness of the print media 304 and adjust the electric field based on the measured thickness. In other examples, the controller 308 may comprise a memory, and the dielectric coefficient of a particular print media 304 may be entered into the controller 308 memory which (e.g. via a look-up table) may associate a particular electric field strength so as to ensure printing fluid migration toward the grounded roller 302 for that print media 304. The strength of the electric field may therefore be relative to the dielectric coefficient of the substrate.

The apparatus 300 may be to substantially cover the print media 304 with ink. For example, the apparatus 300 may be to print a background on a print media 304. In this way the apparatus 300 may be to "flood" the print media 304 with ink. For example, the substrate 304 may be a paper or plastic substrate intended for use with product packaging and the apparatus 100 may be to print a background colour onto the substrate.

The apparatus 300 may comprise an engagement mechanism to move the developer roller 302 relative to the grounded roller 306, or the grounded roller 306 relative to the developer roller 302. For example, the engagement mechanism may be to create a nip between the two rollers 302, 306 for the print media 304 to advance through.

In one example, the controller 308 may apply the electric field between the rollers 302, 306 by supplying current to the developer roller 302. In this example the controller 308 may be to supply current so as to maintain the developer roller 302 at a negative potential. For example, the developer roller 302 may be connected to a source of DC and the controller 308 may be to control the current supplied to the developer roller 302.

For example, the developer roller 302 may be in contact with a rotatable coupling such as a bearing, bushing or brush, and the rotatable coupling may be in contact with a source of DC. For example, the DC source may supply current to the developer roller 302 via a rotatable coupling comprising a conductor. The conductor may comprise a metal. For example, a bearing comprising a metallic bearing housing may be connected to a conductor (e.g. copper wire etc.) connected to a DC source. A rotatable bearing element within the bearing housing may then transfer the current from the conductor, through the bearing housing, to part of the developer roller 302. The developer roller in one example may comprise a semiconducting material. In another example, the developer roller 302 may be in contact (either directly or indirectly) with a source of AC (in some examples, with a rectifier to convert the AC to DC).

In one example, (e.g. in use) the electric field applied by the controller 308 may create a potential difference, or voltage, is created across the gap between the developer roller 302 and the grounded roller 306. The air between the surfaces of the developer roller 302 and grounded roller 306 may develop an electrical conductivity. The apparatus 300 (e.g. under the control of a controller, e.g. controller 308) may then advance the print media 304 in between the charged and grounded rollers 302, 306 (e.g., utilising the engagement mechanism to move them proximate one another), and printing fluid such as ink may be transferred to the developer roller 302, e.g. as described above. As printing fluid is transferred to the developer roller 302, and the developer roller 302 rotates, the printing fluid on the surface of the developer roller 302 will be rotated into proximity with the grounded roller 306, and rotated into proximity with the print media 304 advancing in between the two rollers 302, 306. Due to the potential difference resulting from the applied electric field in between the two rollers 302, 306, printing fluid on the surface of the developer roller 302 may be caused to migrate toward the grounded roller 306 whereupon it will be deposited onto the surface of the print media 304 advancing in between. The applied electric field therefore facilitates the transfer of ink toward the substrate. Therefore, the apparatus 300 deposits ink onto the surface of the print media 304.

The printing fluid may therefore comprise conductive ink and may, when placed in an electric field flow, towards a higher potential. For example the printing fluid may comprise charged particles and an applied electric field may cause the charged particles to move towards a higher potential, for example the ink may comprise negatively charged particles).

Figure 4:
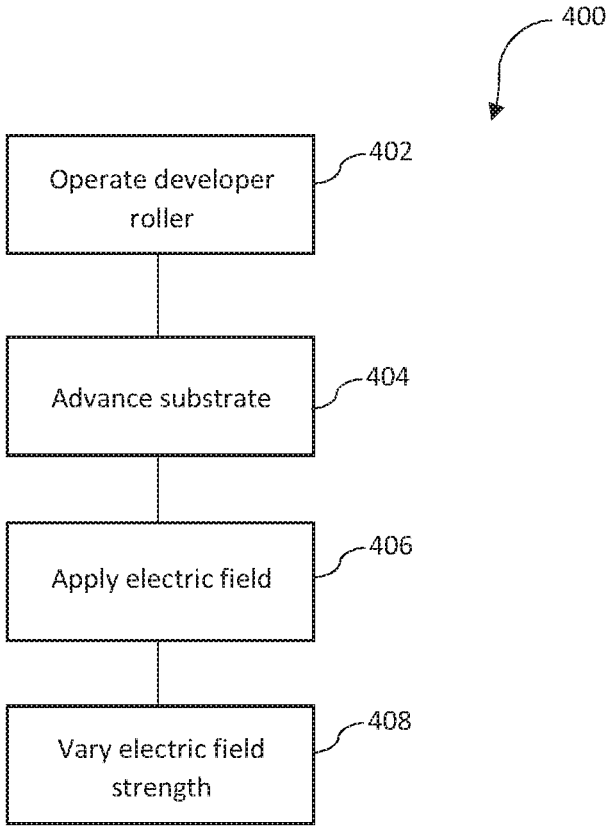
FIG. 4 is a flowchart of an example of a method.

FIG. 4 shows an example method 400. The method 400 may be a method of printing (or transferring or depositing) ink to a substrate. The method 400 may be a method of printing a substrate, or printing to a substrate. The method 400 may be a method of substantially flooding a substrate with printing fluid. The method 400 may be a method of operating a printing apparatus.

The method 400 comprises, at block 402, operating a developer roller to receive printing fluid. In one example, the developer roller may be to transfer printing fluid to a substrate. At block 404 the method 400 comprises advancing a substrate proximate a guide roller, e.g. the guide roller may be to guide the substrate. For example, block 404 may comprise operating a drive unit to advance the substrate. At block 406 the method 400 may comprise applying, by a controller, an electric field between the guide roller and the developer roller. At block 408 the method 400 comprises varying, by a controller, the strength of the electric field based on the dielectric coefficient of the substrate.

Therefore, a controller may be to apply an electric field between the guide roller and the developer roller, and to vary the applied electric field based on the dielectric coefficient of the substrate, and blocks 406 and 408 of method 400 may comprise operating the controller to apply and vary the electric field, respectively. The guide roller may be a grounded roller, e.g. the guide roller may be held at a potential of 0V. Block 404 of method 400, in one example, may comprise advancing the substrate between the guide roller and the developer roller.

In one example the developer roller may be a charged roller and the controller may be to supply current to maintain the developer roller at a negative potential (in examples where the guide roller is grounded). In this example block 406 may comprise supplying a current to the developer roller and block 408 may comprise varying that current. In another example the developer roller and the guide roller may both be held at a positive potential, the guide roller being at a higher potential, and the controller may be to supply current to both rollers. In this example block 406 may comprise supplying current to the developer roller and the guide roller and block 408 may comprise varying that current. Therefore, in one example the controller 408 may be to supply current, or an electrical potential, to each one of the developer rollers and the guide rollers. In this case each roller operates as an electrode to create the potential difference therebetween. In another example, applying the electric field (block 406) may comprise applying a current, or an electrical potential, to two electrodes, for example two plates each having a different electrical potential.

Figure 5:
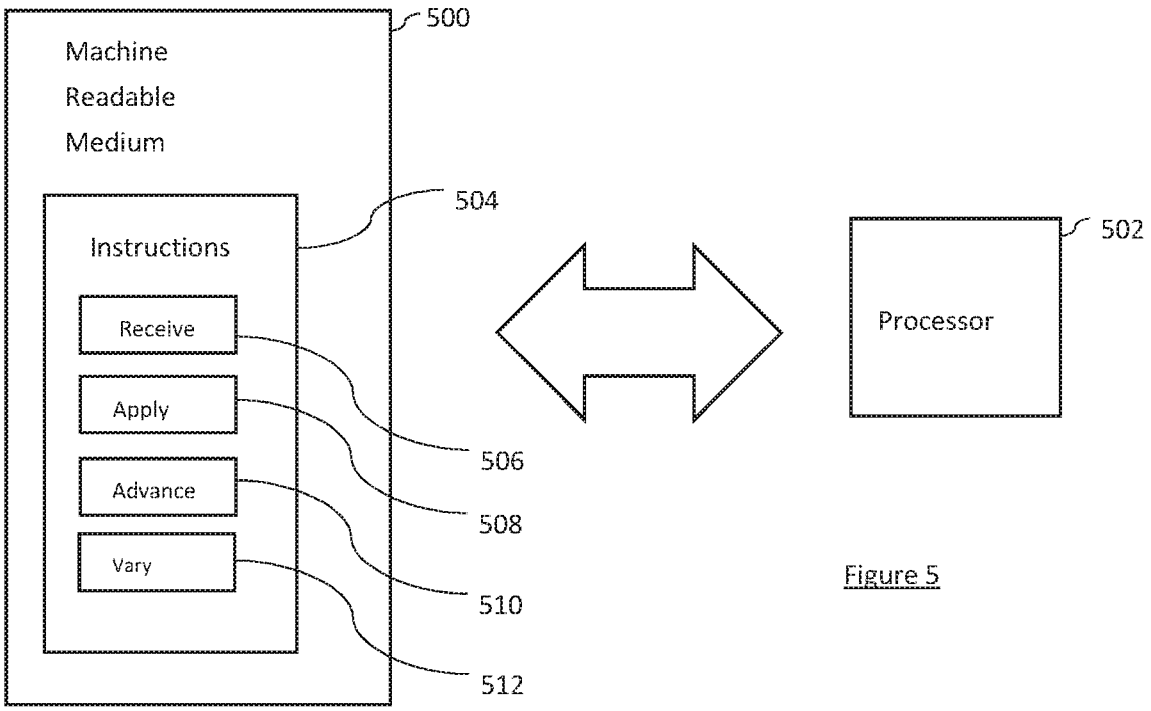
FIG. 5 is an example of a machine readable medium in association with a processor.

FIG. 5 shows an example tangible (and non-transitory) machine readable medium 500 in association with a processor 502. The tangible machine readable medium 500 comprises instructions 504 which, when executed by the processor 502, cause the processor 502 to carry out a plurality of tasks. The instructions 504 comprises instructions 506 to receive ink at a developer roller. The instructions 504 comprises instructions 508 to apply an electric field in the region of the developer roller. The instructions 504 comprises instructions 510 to Advance a substrate proximate the developer roller. The instructions 504 comprises instructions 512 vary the strength of the electric field based on a dielectric coefficient of the substrate.

In one example, the instructions 504 comprise instructions to advance the substrate in between the developer roller and an electrically grounded roller. In one example the instructions 504 comprise instructions to maintain the grounded roller at 0V.

In one example, the instructions 504 comprise instructions to supply current to the developer roller to create a potential difference between the developer roller and a region proximate the substrate.

In one example, the instructions 504 comprise instructions to supply a first current to the developer roller and a second current to a second, guide, roller (e.g. proximate the substrate) to thereby create (in one example, maintain) a potential difference between the developer and guide rollers.

Examples in the present disclosure can be provided as methods, systems or machine readable instructions, such as any combination of software, hardware, firmware or the like. Such machine readable instructions may be included on a computer readable storage medium (including but is not limited to disc storage, CD-ROM, optical storage, etc.) having computer readable program codes therein or thereon.

The present disclosure is described with reference to flow charts and/or block diagrams of the method, devices and systems according to examples of the present disclosure. Although the flow diagrams described above show a specific order of execution, the order of execution may differ from that which is depicted. Blocks described in relation to one flow chart may be combined with those of another flow chart. It shall be understood that each flow and/or block in the flow charts and/or block diagrams, as well as combinations of the flows and/or diagrams in the flow charts and/or block diagrams can be realized by machine readable instructions.

The machine readable instructions may, for example, be executed by a general purpose computer, a special purpose computer, an embedded processor or processors of other programmable data processing devices to realize the functions described in the description and diagrams. In particular, a processor or processing apparatus may execute the machine readable instructions. Thus functional modules of the apparatus and devices may be implemented by a processor executing machine readable instructions stored in a memory, or a processor operating in accordance with instructions embedded in logic circuitry. The term 'processor' is to be interpreted broadly to include a CPU, processing unit, ASIC, logic unit, or programmable gate array etc. The methods and functional modules may all be performed by a single processor or divided amongst several processors.

Such machine readable instructions may also be stored in a computer readable storage that ca guide the computer or other programmable data processing devices to operate in a specific mode.

Such machine readable instructions may also be loaded onto a computer or other programmable data processing devices, so that the computer or other programmable data processing devices perform a series of operations to produce computer-implemented processing, thus the instructions executed on the computer or other programmable devices realize functions specified by flow(s) in the flow charts and/or block(s) in the block diagrams.

Further, the teachings herein may be implemented in the form of a computer software product, the computer software product being stored in a storage medium and comprising a plurality of instructions for making a computer device implement the methods recited in the examples of the present disclosure.

While the method, apparatus and related aspects have been described with reference to certain examples, various modifications, changes, omissions, and substitutions can be made without departing from the spirit of the present disclosure. It is intended, therefore, that the method, apparatus and related aspects be limited only by the scope of the following claims and their equivalents. It should be noted that the above-mentioned examples illustrate rather than limit what is described herein, and that those skilled in the art will be able to design many alternative implementations without departing from the scope of the appended claims.

The word "comprising" does not exclude the presence of elements other than those listed in a claim, "a" or "an" does not exclude a plurality, and a single processor or other unit may fulfil the functions of several units recited in the claims.

The features of any dependent claim may be combined with the features of any of the independent claims or other dependent claims.

The invention claimed is:

1. An apparatus comprising:

a developer roller to transfer printing fluid on the developer roller to a substrate; and an electrically grounded roller to guide the substrate in between the developer roller and the electrically grounded roller, wherein an electrical potential source is connected to the developer roller to create an electric field between the developer roller and the electrically grounded roller.

2. The apparatus according to claim 1, wherein the substrate is a print media.

3. The apparatus according to claim 1, wherein the electrical potential source is a source of a direct current, the apparatus further comprising a controller to vary a strength of the direct current in proportion to a dielectric coefficient of the substrate or a thickness of the substrate.

4. The apparatus according to claim 1, wherein the electrical potential source is a source of alternating current, the apparatus further comprising a controller to vary a strength or a frequency of the alternating current.

5. The apparatus according to claim 1, wherein the electrical potential source is a source of direct current that causes the developer roller to be held at a negative potential.

6. A method comprising:

receiving printing fluid at a developer roller, applying an electric field in a region of the developer roller;

advancing a substrate proximate the developer roller; and varying a strength of the electric field based on a dielectric coefficient of the substrate or a thickness of the substrate.

7. The method according to claim 6, wherein advancing the substrate proximate the developer roller comprises advancing the substrate between the developer roller and an electrically grounded roller.

8. The method according to claim 6, wherein applying the electric field in the region of the developer roller comprises supplying a current to the developer roller to create a potential difference between the developer roller and the region through the substrate.

9. The method according to claim 8, wherein advancing the substrate proximate the developer roller comprises advancing the substrate in between the developer roller and a guide roller, and wherein applying the electric field in the region of the develop roller comprises:

supplying a current to the developer roller and connecting the guide roller to a ground to thereby create a potential difference between the developer roller and the guide roller.

10. The method according to claim 8, wherein advancing the substrate proximate the developer roller comprises advancing the substrate in between the developer roller and a guide roller, and wherein applying the electric field in the region of the develop roller comprises:

supplying a first current to the developer roller and a second current to the guide roller to create a potential difference between the developer roller and the guide roller, the first current being different from the second current.

11. An apparatus comprising a developer roller to receive printing fluid and to transfer a portion of the printing fluid to a print media;

an electrically grounded roller to direct the print media in between the developer roller and the electrically grounded roller, and a controller to apply an electric field between the developer roller and the electrically grounded roller.

12. The apparatus according to claim 11, wherein the controller is to vary a strength of the electric field based on a dielectric coefficient or a thickness of the print media.

13. The apparatus according to claim 11, wherein the apparatus further comprises an engage mechanism to move one of the developer roller and the electrically grounded roller to a position proximate to the other.

14. The apparatus according to claim 11, wherein the controller is to supply current to the developer roller to create the electric field between the developer roller and the electrically grounded roller.

15. The apparatus according to claim 14, wherein the controller is to supply current to the developer roller to maintain the developer roller at a negative potential.

* * * * *